US006488536B2

(12) United States Patent
Fukamachi

(10) Patent No.: US 6,488,536 B2
(45) Date of Patent: Dec. 3, 2002

(54) CONNECTOR WITH INCORRECT FITTING PREVENTION MEANS

(75) Inventor: Makoto Fukamachi, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/894,011

(22) Filed: Jun. 29, 2001

(65) Prior Publication Data

US 2002/0002001 A1 Jan. 3, 2002

(30) Foreign Application Priority Data

Jul. 3, 2000 (JP) ..... 2000-201053

(51) Int. Cl.[7] ..... H01R 13/40
(52) U.S. Cl. ..... 439/595; 439/872
(58) Field of Search ..... 439/595, 872, 439/733.1, 680, 752.5

(56) References Cited

U.S. PATENT DOCUMENTS 5,190,477 A * 3/1993 Akeda ..... 439/595
5,393,248 A * 2/1995 Yagi et al. ..... 439/595
5,613,878 A * 3/1997 Tsuji et al. ..... 439/595
5,630,733 A * 5/1997 Jinno et al. ..... 439/595
6,048,226 A * 4/2000 Iwahori ..... 439/595

FOREIGN PATENT DOCUMENTS

JP 8-45591 2/1996

* cited by examiner

*Primary Examiner*—Gary Paumen
*Assistant Examiner*—Ann McCamey
(74) *Attorney, Agent, or Firm*—Banner & Witcoff, Ltd.

(57) ABSTRACT

A connector has means for preventing terminal fittings from being inserted in an inverted manner, and in which nothing protrudes from outer faces of these terminal fittings. Cut-away portions 17 are formed at a ceiling side of anterior ends of left and right side plates 11B of a box-shaped member 11 of a terminal fitting 10. Protrusions 34 are formed within a cavity 24 at anterior ends of left and right wall faces thereof, in locations somewhat removed from a wall face having a lance 26 formed thereon. These protrusions 34 are capable of fitting into the cut-away portions 17. When the terminal fitting 10 is correctly inserted, the protrusions 34 fit into the cut-away portions 17, and the terminal fitting 10 is pushed into a correct position and is retained by the lance 26. When the terminal fitting 10 is inserted in an inverted manner, the anterior end of the box-shaped member 11 strikes against the protrusions 34 before the terminal fitting 10 reaches the correct position. Consequently, the terminal fitting 10 is prevented from being inserted any further, and it is not retained by the lance 26.

20 Claims, 6 Drawing Sheets

CONNECTOR WITH INCORRECT FITTING PREVENTION MEANS

TECHNICAL FIELD

The present invention relates to a connector provided with means for preventing terminal fittings from being inserted in an inverted manner.

BACKGROUND TO THE INVENTION

One conventional means for ensuring that terminal fittings are inserted correctly into cavities formed in a connector housing comprises stabilizers protruding from specified locations of outer faces of the terminal fittings, and guiding grooves formed in corresponding wall faces of the cavities, the stabilizers being capable of sliding within these guiding grooves. When the terminal fittings are inserted correctly, the stabilizers slide within the guiding grooves as insertion progresses. When the terminal fittings are inserted in an inverted manner, the stabilizers strike against hole edges of openings of the cavities, thereby preventing insertion from continuing. An example of this type of terminal fitting provided with stabilizers is described in JP-8-45591.

In the conventional example which is provided with stabilizers and guiding grooves, the guiding grooves are cut away in the walls separating the cavities. Consequently, these walls must be thicker, i.e., the pitch of the cavities must be increased. As a result, the connector must be made larger in size.

Conventionally, in order to miniaturize a multi-pole waterproofed connector, separate rubber stoppers are replaced by a rubber stopper comprising a single sheet having a plurality of through holes therein. This sheet covers posterior faces of all the cavities, thereby waterproofing all the cavities in a collective manner. However, when stabilizers protrude from the terminal fittings, as in the case described above, the terminal fittings may damage inner circumference faces of the through holes of the collective rubber stopper into which they have been inserted, thereby decreasing the waterproofing reliability of the rubber stopper.

The present invention has taken the above problems into consideration, and aims to present a connector having a means for preventing terminal fittings from being inserted in an inverted manner, and in which nothing protrudes from outer faces of these terminal fittings.

SUMMARY OF THE INVENTION

According to the invention, there is provided an electrical connector comprising a housing, a cavity within said housing, and a terminal fitting insertable in said cavity, said terminal fitting being engageable by retention means at a predetermined insertion depth characterized in that the insertion end of said terminal fitting has a cut-away portion at one side, and said housing include a protrusion extending into said cavity at a corresponding side and for fitting within said cut-away portion at said predetermined insertion depth, whereby a predetermined orientation of said terminal fitting is assured.

Such an arrangement ensures that the terminal fitting can reach the desired insertion depth only if inserted in the correct orientation. No protrusions are required, the corresponding disadvantages are thus avoided, and the connector housing can be miniaturized.

Preferably the terminal fitting is tubular, and the cut-away portion comprises part of the tubular wall. In a preferred embodiment the terminal fitting is rectangular in cross-section at the insertion end.

An engagement member of the retention means may be constituted by an aperture or step in the tubular wall, and this engagement member is preferably provided on the same side of the terminal fitting as the cut-away portion.

In a preferred embodiment, cut-away portions are provided on either side of a resilient tongue of a female terminal fitting, the tongue comprising a contact member of the female fitting for engagement with a corresponding male terminal fitting.

BRIEF DESCRIPTION OF DRAWINGS

Other features of the invention will be apparent from the following description of preferred embodiments shown by way of example only in the accompanying drawings in which.

DESCRIPTION OF PREFERRED EMBODIMENTS

A first embodiment of the present invention, which is suitable for a female waterproof connector, is described below with the aid of FIGS. 1 to 8.

Figure 1:
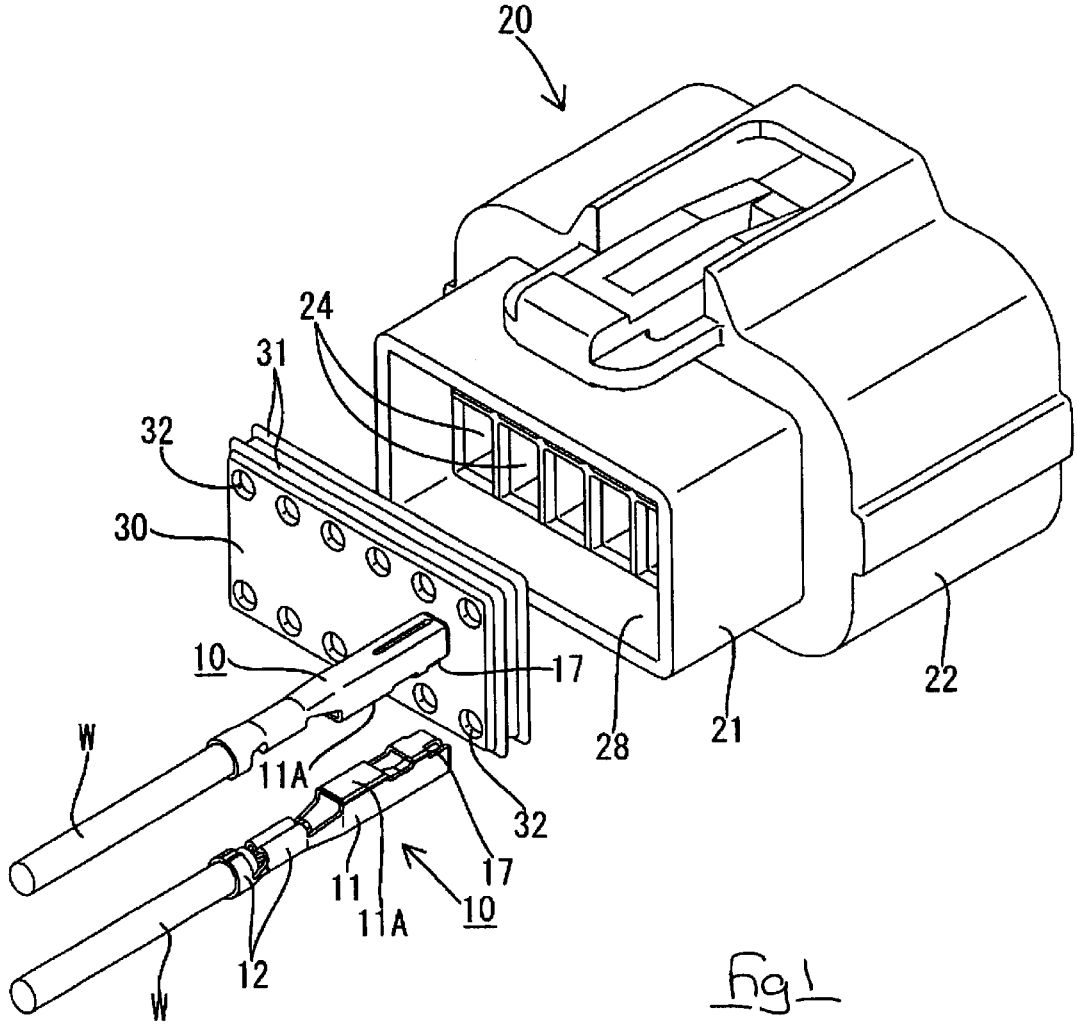
FIG. 1 is a disassembled diagonal view of a first embodiment of the present invention.
Figure 2:
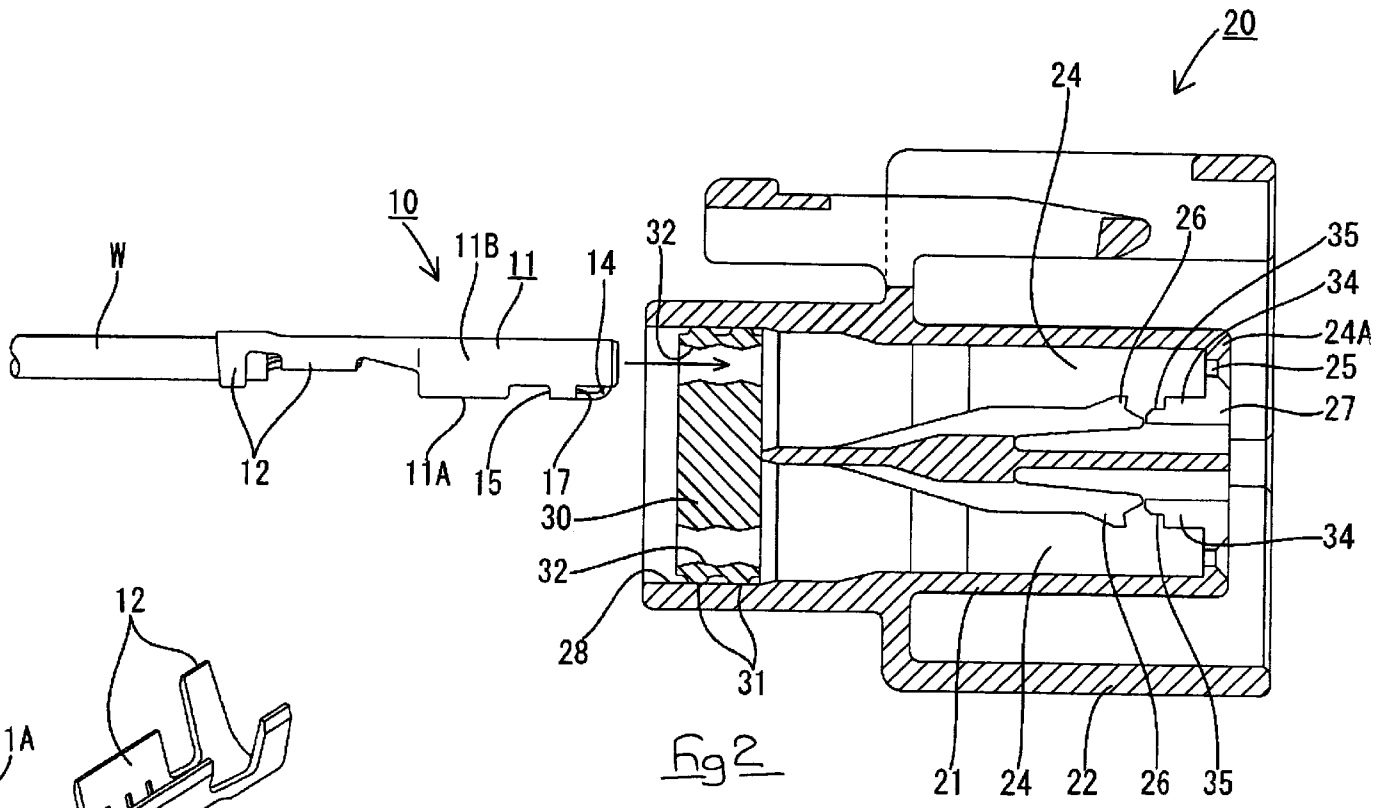
FIG. 2 is a vertical cross-sectional view of a female terminal fitting prior to insertion.

As shown in FIGS. 1 and 2, this connector is provided with a female connector housing 20 (hereafter referred to as female housing), female terminal fittings 10 housed within the female housing 20, and a collective waterproofing rubber stopper 30.

Figure 3:
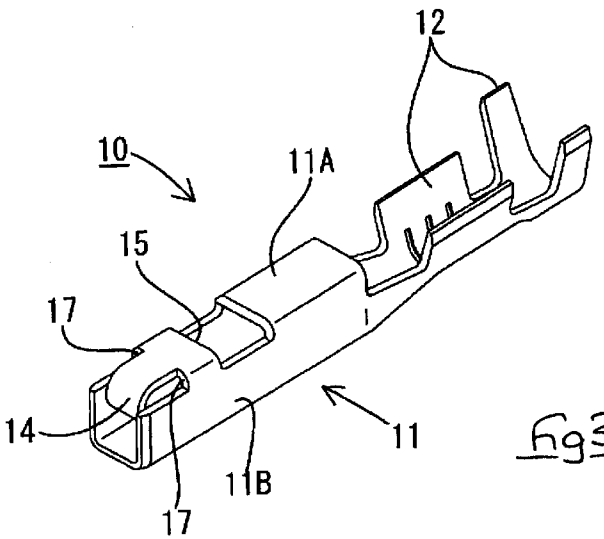
FIG. 3 is a diagonal view of the female terminal fitting.
Figure 4:
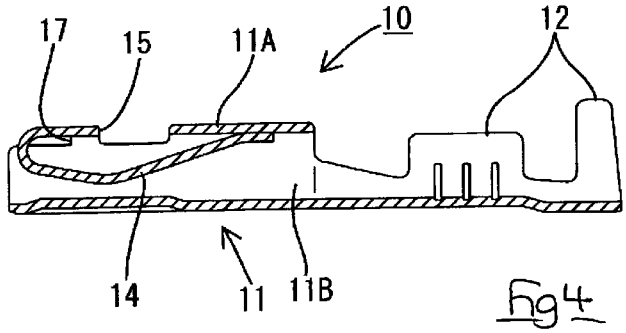
FIG. 4 is a vertical cross-sectional view of the female terminal fitting.

Each female terminal fitting 10 is formed from sheet metal which is press moulded. As shown in FIGS. 3 and 4, the female terminal fitting 10 has a configuration whereby a barrel 12 is formed at a posterior end of an angular tubular shaped box-shaped member 11. A resilient tongue member 14 is bent inwards in an angled shape from an anterior edge of a ceiling plate 11A of the box-shaped member 11. A stopping hole 15 opens at a central location, relative to the lengthwise direction thereof, of the ceiling plate 11A. The female terminal fitting 10 is joined to the end of a covered electric wire W by crimping the barrel 12 therewith.

Figure 9:
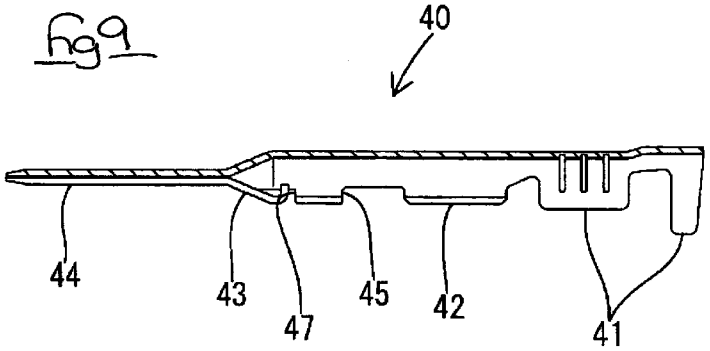
FIG. 9 is a vertical cross-sectional view showing a male terminal fitting of a second embodiment of the present invention in a state prior to insertion.

The female housing 20 is made from plastic and has a flattened box-like tower member 21, the anterior end portion of which is surrounded by a hood 22. Cavities 24, into which the female terminal fittings 10 can be inserted, are formed in an upper and a lower set within the tower member 21. Each set has five cavities 24, these upper and lower cavities 24 mutually facing one another. A terminal insertion hole 25 opens into an anterior face wall 24A of each cavity 24, this allowing the insertion of a tab 44 of a corresponding male terminal fitting 40 (see FIG. 9, showing the second embodiment). Bendable lances 26, which are capable of engaging with the stopping holes 15 of the female terminal fittings 10, are provided within each cavity 24, these being formed on wall faces of the walls between the upper and lower cavities 24. A jig insertion hole 27 opens into the anterior face wall 24A of each cavity 24 at a location to the anterior of each lance 26. These jig insertion holes 27 pass through to the terminal insertion holes 25.

A rubber stopper attachment member 28 is formed within the posterior end of the tower member 21, this being formed across the entire length thereof by eliminating the partition walls between the cavities 24. The collective rubber stopper 30 is fitted to this rubber stopper attachment member 28. The rubber stopper 30 has a horizontally rectangular plate shape when viewed from the front and is capable of fitting within the rubber stopper attachment member 28. Two lips 31, one anterior and one posterior, are formed along an outer circumference face of the rubber stopper 30. Through holes 32, into which the covered electric wires W can be tightly fitted, are formed in the plate face of the rubber stopper 30 at locations corresponding to the cavities 24 of the female housing 20.

Figure 5:
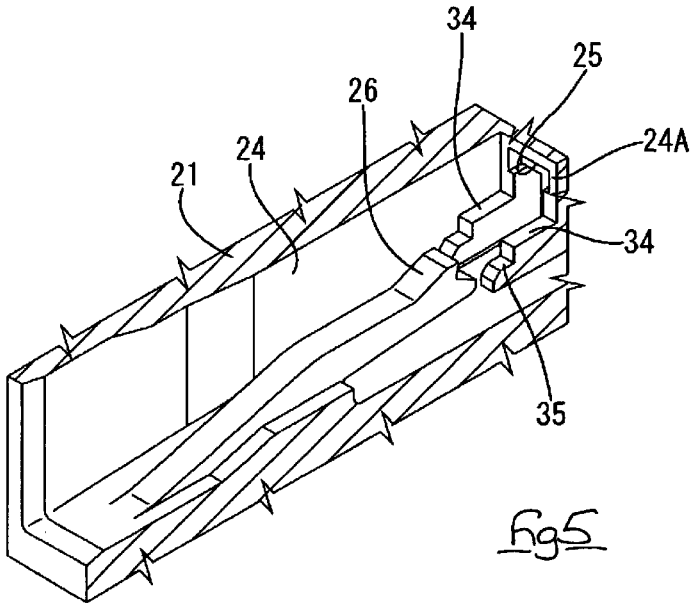
FIG. 5 is a diagonal view showing the configuration of the interior of a cavity of a female housing.
Figure 6:
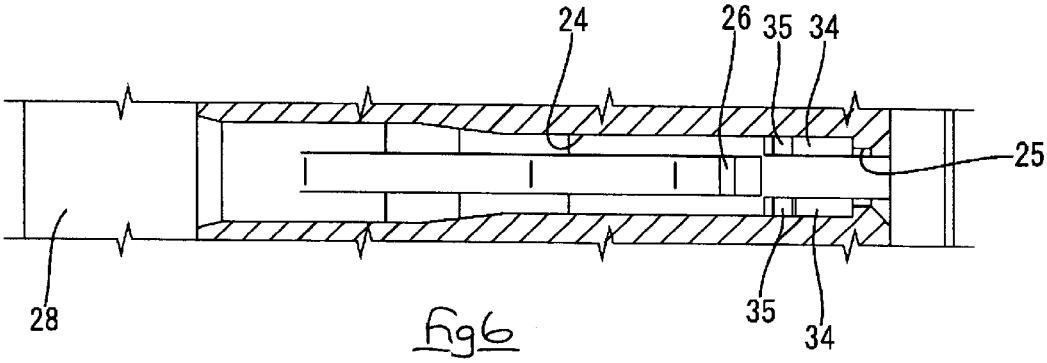
FIG. 6 is a plan cross-sectional view showing the configuration of the interior of the cavity of the female housing.
Figure 7:
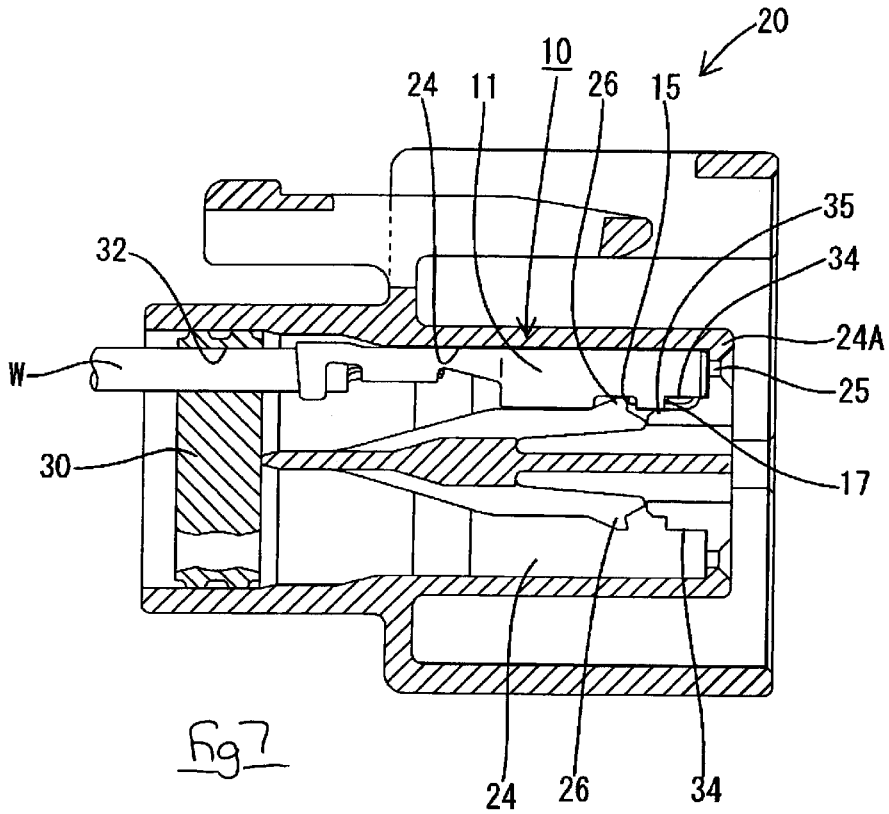
FIG. 7 is a vertical cross-sectional view showing the female terminal fitting in a correctly inserted state.

Cut-away portions 17 are formed in ceiling sides of anterior ends of left and right side plates 11B of the box-shaped member 11 of each female terminal fitting 10. As shown in FIGS. 5 and 6, protrusions 34 are formed within each cavity 24 at anterior ends of left and right wall faces thereof, in locations somewhat removed from the wall faces having the lances 26 formed thereon. These protrusions 34 are capable of fitting into the cut-away portions 17 formed in the box-shaped members 11 of the female terminal fittings 10. When the anterior ends of the box-shaped members 11 of the female terminal fittings 10 have made contact with the anterior face walls 24A of the cavities 24, the protrusions 34 fit into these cut-away portions 17. Furthermore, supports 35 adjoin posterior ends of the protrusions 34. These supports 35 are formed at a lower level than the protrusion 34 and support the posterior side of the cut-away portions 17 in the side plates 11B of the box-shaped members 11.

The operation of the first embodiment will be described below. First, as shown in FIG. 2, the collective rubber stopper 30 is fitted into the rubber stopper attachment member 28 within the tower member 21 of the female housing 20. From this state, the female terminal fittings 10 are inserted. As shown in FIG. 1, the upper set of female terminal fittings 10 are inserted with the ceiling plates 11A of the box-shaped members 11 thereof facing downwards, and the lower set of female terminal fittings 10 are inserted with the ceiling plates 11A of the box-shaped members 11 thereof facing upwards.

Using the upper set of female terminal fittings 10 as an example, the female terminal fittings 10 are passed through the upper set of through holes 32 in the rubber stopper 30 (as shown by the arrow in FIG. 2), and are inserted from the posterior into the cavities 24. As the female terminal fittings 10 are inserted they cause the lances 26 to bend, and if the female terminal fittings 10 are inserted correctly (i.e., the ceiling plates 11A of the box-shaped members 11 thereof are facing downwards), the protrusions 34 of the cavities 24 fit into the cut-away portions 17, and the female terminal fittings 10 are inserted until they make contact with the anterior face walls 24A of the cavities 24 (see FIG. 7). At this juncture, the stopping holes 15 are located at positions corresponding to the lances 26. These lances 26 return to their original position and fit into the stopping holes 15, thereby causing the female terminal fittings 10 to be housed in an unremovable state within the cavities 24. In addition, inner circumference faces of the through holes 32 of the rubber stopper 30 fit tightly with outer circumference faces of the covered electric wires W.

Figure 8:
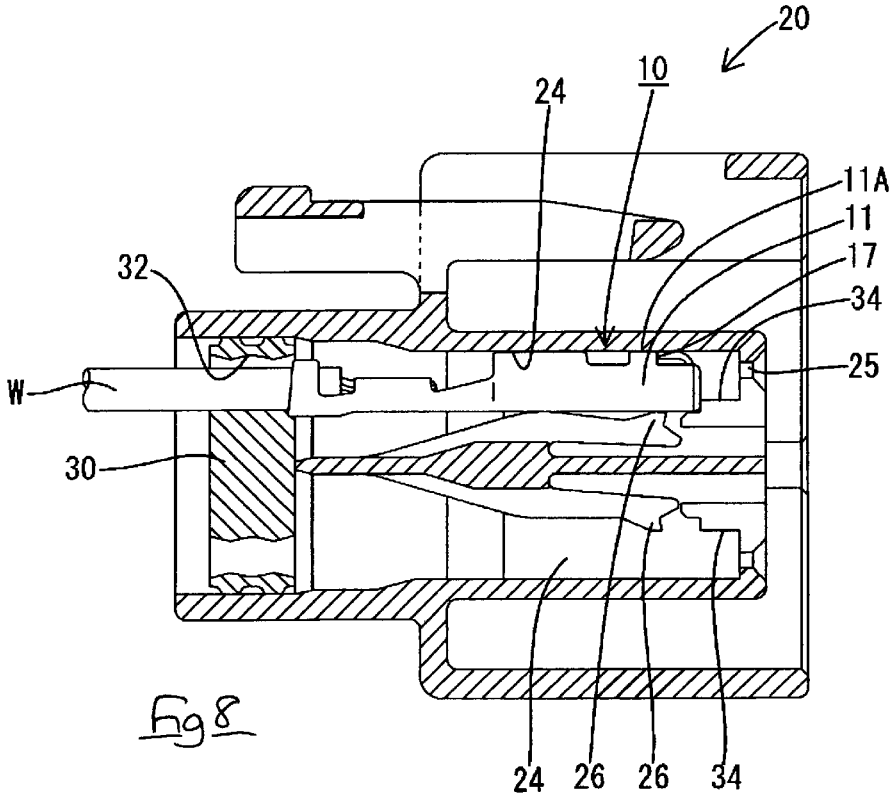
FIG. 8 is a vertical cross-sectional view showing the female terminal fitting inserted in an inverted manner.

If the upper set of female terminal fittings 10 are inserted incorrectly, that is, the ceiling plates 11A of the box-shaped members 11 thereof are facing upwards, the anterior ends of the box-shaped members 11 strike against the protrusions 34 before the female terminal fittings 10 have been inserted to the correct position within the cavities 24 (see FIG. 8). Further insertion is thus prevented. Since the female terminal fittings 10 are not being retained by the lances 26, they can be removed by pulling the covered electric wires W towards the posterior. In this manner, it can be detected that the female terminal fittings 10 have been inserted in an inverted manner. The female terminal fittings 10 can now be turned over so as to face the correct direction for insertion, and re-inserted.

In the same way, if the lower set of female terminal fittings 10 are inserted correctly, i.e., the ceiling plates 11A of the box-shaped members 11 thereof are facing upwards, the female terminal fittings 10 are inserted to the correct position with the protrusions 34 fitting into the cut-away portions 17, and the female terminal fittings 10 are retained by the lances 26. If the lower set of female terminal fittings 10 are inserted incorrectly, i.e., the ceiling plates 11A of the box-shaped members 11 thereof are facing downwards, the anterior ends of the box-shaped members 11 strike against the protrusions 34, thereby preventing further insertion, and preventing the female terminal fittings 10 form being inserted in an inverted manner.

In the present embodiment which has been described above, the means for preventing the female terminal fittings 10 from being inserted in an inverted manner consists of a configuration whereby the cut-away portions 17 are provided in the box-shaped members 11 of the female terminal fittings 10, and the protrusions 34, which fit into the cut-away portions 17, are formed within the cavities 24. That is, the female terminal fittings 10 have no members (such as the stabilizers in the conventional example) protruding therefrom. Consequently, the walls separating the cavities 24 do not need to be thicker in order to house these protruding members. As a result, the pitch of the cavities 24 can be kept small, and the connector can be miniaturized.

Furthermore, since no members protrude from the female terminal fittings 10, there is no danger of damaging the inner circumference faces of the through holes 32 (through which the female terminal fittings 10 are passed) of the collective rubber stopper 30, and the seal thereof can reliably be maintained.

Moreover, the anterior ends of the left and right side plates 11B of the box-shaped members 11 of the female terminal fittings 10 are usually cut away in advance in order to allow the resilient tongue member 14 to be bent conveniently. These cut away areas are employed as the cut-away portions 17 which prevent inverted insertion from taking place. Consequently, no further cutting away, which would weaken the box-shaped members 11, is required. Further, no changes are made to the female terminal fittings 10. Instead, changes are only made to the structure of the cavities 24 of the female housing 20.

Next, a second embodiment of the prevent invention, this being suitable for a male connector, is described below with the aid of FIGS. 9 to 14.

Figure 10:
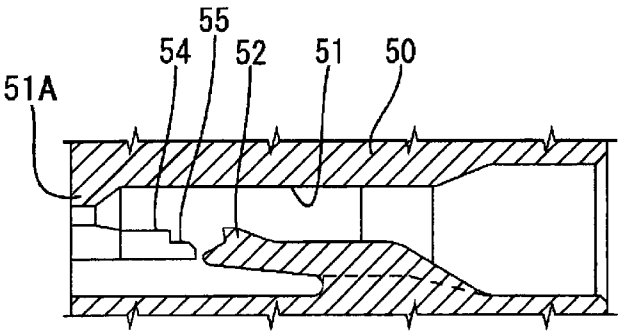
FIG. 10 is a diagonal view of the male terminal fitting.
Figure 10:
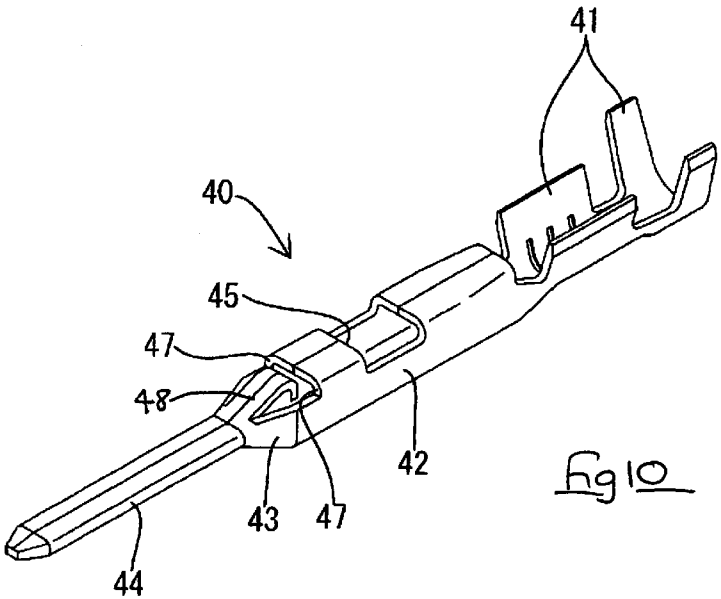

As shown in FIGS. 9 and 10, a male terminal fitting 40 is formed from (beginning from the posterior end and proceeding towards the anterior): a barrel 41, an angular tubular box-shaped member 42, a tapering head member 43, and a tab 44. As shown in FIG. 9, this male terminal fitting 40 is inserted from the posterior into a cavity 51 of a male housing 50, and is retained therein in an unremovable state by means of a lance 52, the tab 44 protruding from an anterior face wall 51A.

A ceiling side of the male terminal fitting 40, extending from the head member 43 to the anterior end of the box-shaped member 42, has a left and right pair of cut-away portions 47 formed therein.

Figure 11:
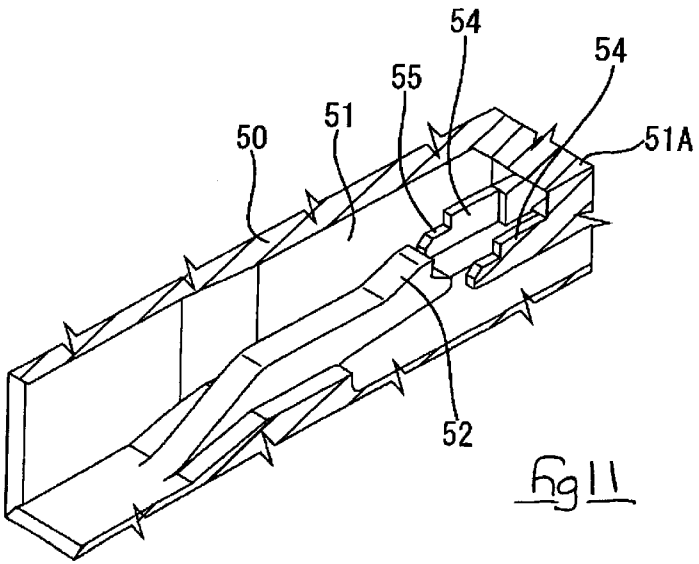
FIG. 11 is a diagonal view showing the configuration of the interior of a cavity of a male housing.
Figure 12:
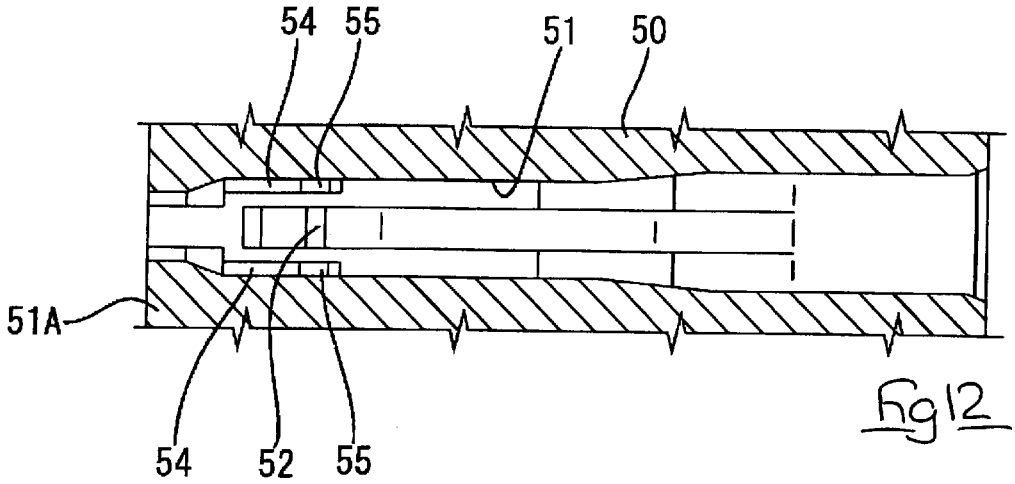
FIG. 12 is a plan cross-sectional view showing the configuration of the interior of the cavity of the male housing.
Figure 13:
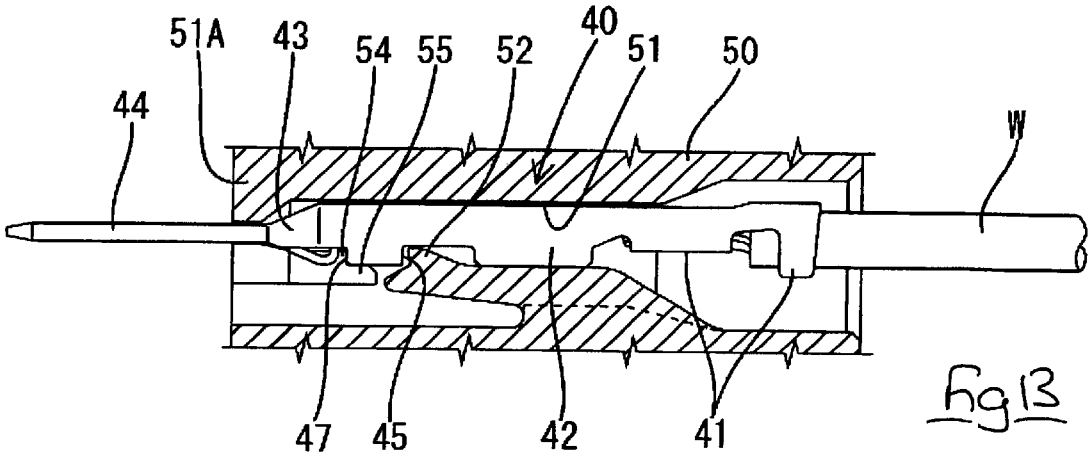
FIG. 13 is a vertical cross-sectional view showing the male terminal fitting in a correctly inserted state.

As shown in FIGS. 11 and 12, protrusions 54 are formed at anterior ends of left and right wall faces within the cavity 51, in locations somewhat removed from the wall face which has the lance 52 formed thereon. These protrusions 54 fit into the cut-away portions 47 of the male terminal fitting 40. Supports 55 adjoin posterior ends of the protrusions 54. These supports 55 are formed at a lower level than the protrusions 54 and support the posterior side of the cut-away portions 47 of the box-shaped member 42.

In the second embodiment, if the male terminal fitting 40 is inserted correctly into the cavity 51 (see FIG. 13), the protrusions 54 within the cavity 51 fit into the cut-away portions 47, the male terminal fitting 40 is pushed in to a correct position whereby the head member 43 strikes against the anterior face wall 51A, and the lance 52 fits resiliently into a stopping hole 45. The male terminal fitting 40 is thereby housed in an unremovable manner.

Figure 14:
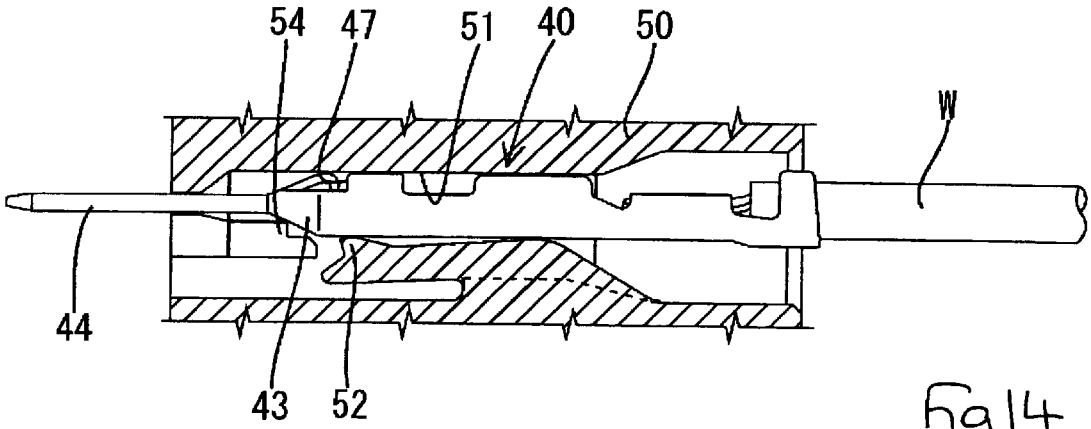
FIG. 14 is a vertical cross-sectional view showing the male terminal fitting inserted in an inverted manner.

If the male terminal fitting 40 is inserted in an inverted manner in the cavity 51, the head member 43 thereof strikes against the protrusions 54 before the male terminal fitting 40 has been inserted to the correct position (see FIG. 14). Since further insertion is thus prevented and the male terminal fitting 40 is not being retained by the lance 52, it can be ascertained that the male terminal fittings 40 has been inserted in an inverted manner.

In this second embodiment also, the means for preventing the male terminal fitting 40 from being inserted in an inverted manner consists of a configuration whereby the male terminal fitting 40 has no members (such as the stabilizers in the conventional example) protruding therefrom. Consequently, the walls separating the cavities 51 do not need to be thicker in order to house these protruding members, and the pitch of the cavities 51 can be kept small. As a result, the connector can be miniaturized. Furthermore, no damage will occur to a waterproofing collective rubber stopper in the case where one is employed.

The present invention is not limited to the embodiments described above with the aid of figures. For example, the possibilities described below also lie within the technical range of the present invention. In addition, the present invention may be embodied in various other ways without deviating from the scope thereof.

(1) The cut-away portions of the terminal fittings and the protrusions of the cavities may be provided on either the right side alone or the left side alone.

(2) The present invention is also suitable for a regular connector which uses no waterproofing means.

What is claimed is:

1. An electrical connector comprising a housing, a cavity within said housing, and a terminal fitting insertable in said cavity in a fitting direction, said terminal fitting being engageable by retention means at a predetermined insertion depth to prevent removal of the terminal fitting in a direction opposite to the fitting direction, wherein said terminal fitting has a cut-away portion at the periphery thereof and said housing includes a protrusion extending into said cavity at a corresponding side, said protrusion fitting within said cut-away portion when said terminal fitting is inserted into said cavity to said predetermined insertion depth and engaging said terminal fitting to prevent insertion of said terminal fitting to said predetermined insertion depth when said terminal fitting is reverse oriented, whereby a predetermined orientation of said terminal fitting is assured.

2. A connector according to claim 1 wherein said terminal fit ting is male and defines a tab and a tubular body portion, wherein said cut-away portion is adjacent the inner end of said tab.

3. A connector according to claim 1 and having a plurality of cavities and corresponding terminal fittings, said housing further including a single resilient plate-like waterproof stopper at the insertion opening of said cavities, and said stopper defining a respective aperture for each cavity, each aperture being adapted to tightly engage a wire attached to the posterior end of the respective terminal fitting.

4. A connector according to claim 1 wherein said terminal fitting further defines an engagement member for said retention means, said member being posterior of said cut-away portion.

5. A connector according to claim 1 wherein said terminal fitting is tubular, the tubular wall being cut-away to define said cut-away portion.

6. A connector according to claim 4 wherein said terminal fitting is tubular, the tubular wall being cut-away to define said cut-away portion.

7. A connector according to claim 5 wherein said terminal fitting has a box-like cross-section at said cut-away portion.

8. A connector according to claim 6 wherein said terminal fitting has a box-like cross-section at said cut-away portion.

9. A connector according to claim 7 wherein said terminal fitting has an internal resilient tongue extending from the insertion end thereof towards the posterior, said cut-away portion being provided adjacent said tongue.

10. A connector according to claim 9 wherein said cut-away portion is provide symmetrically on either side of said tongue.

11. A connector according to claim 8 wherein said terminal fitting has an internal resilient tongue extending from the insertion end thereof towards the posterior, said cut-away portion being provided adjacent said tongue.

12. A connector according to claim 11 wherein said cut-away portion is provide symmetrically on either side of said tongue.

13. A connector according to claim 1 wherein said cut-away portion is provided at a fitting end of said terminal fitting.

14. A connector according to claim 13 wherein said terminal fitting is female.

15. A connector according to claim 14 wherein said cut-away portion is provided on either side of a tongue, said tongue defining a ramp to aid smooth insertion of said terminal through a close fitting aperture of said cavity.

16. A connector according to claim 15 wherein said aperture comprises a resilient opening.

17. A connector according to claim 13 wherein said cut-away portion is provided on either side of a tongue, said tongue defining a ramp to aid smooth insertion of said terminal through a close fitting aperture of said cavity.

18. A connector according to claim 17 wherein said aperture comprises a resilient opening.

19. A connector according to claim 1 and further including a resilient waterproof stopper at the insertion opening of said cavity, and said terminal fitting has a wire attached thereto, said stopper defining an aperture smaller than the diameter of said wire.

20. A connector according to claim 19 wherein said housing defines a tubular mouth to receive said stopper, and said stopper includes a continuous peripheral sealing lip to engage the interior wall of said tubular mouth.

* * * * *